United States Patent [19]

Takayama et al.

[11] Patent Number: 4,967,777

[45] Date of Patent: Nov. 6, 1990

[54] APPARATUS FOR TREATING SUBSTRATES WITH A LIQUID

[75] Inventors: Michio Takayama, Yono; Akihiko Hayakawa, Toda, both of Japan

[73] Assignee: Texas Instruments Incorporated, Dallas, Tex.

[21] Appl. No.: 386,838

[22] Filed: Jul. 27, 1989

[30] Foreign Application Priority Data

Jul. 29, 1988 [JP] Japan ..... 63-191227

[51] Int. Cl.[5] ..... B08B 3/04

[52] U.S. Cl. ..... 134/102; 4/206; 134/182; 134/186; 134/902; 210/537

[58] Field of Search ..... 134/155, 182, 183, 186; 68/181 R; 4/198–202, 206, 651; 210/221.1, 537, 923

[56] References Cited

U.S. PATENT DOCUMENTS

| | | | |
|---|---|---|---|
| 1,232,370 | 7/1917 | Morison | 210/537 X |
| 3,543,776 | 12/1970 | Layton | 134/182 X |
| 3,739,436 | 6/1973 | Naujoks et al. | 68/181 X |
| 4,753,258 | 6/1988 | Seiichiro | 134/186 |

*Primary Examiner*—Philip R. Coe

*Attorney, Agent, or Firm*—William E. Hiller; N. Rhys Merrett; Melvin Sharp

[57] ABSTRACT

An apparatus for treating an object with a liquid in which the object is immersed into the liquid in a tank which has overflow control members provided above faces of the tank with a predetermined space in an overflow area for said liquid, said space being structured to lead the overflow of said liquid by capillary action.

8 Claims, 8 Drawing Sheets

APPARATUS FOR TREATING SUBSTRATES WITH A LIQUID

BACKGROUND OF THE INVENTION

1. Field of the Invention

This invention relates to an apparatus for treating substrates with a liquid, for example, to such apparatus which chemically treats or cleans a substrate with chemical solutions or water.

2. Description of the Prior Art

Conventionally, thin plates or substrates (which are referred to simply as "substrates" hereinafter), such as semiconductor wafers, glass masks, reticles, compact disks or laser disks, have been kept vertical to undergo a drying process after being treated or cleaned with chemical solutions or deionized water (D. I. water).

In such conventional drying methods, there is a method wherein after a substrate 3 (see FIGS. 12–15) which is contained vertically in a recess 2 in a cassette 1 has been cleaned, liquid adhering to its surface is removed by centrifugal force in a high speed spinning machine.

However, problems of this method are that the substrate itself may be cracked by the high speed spinning, and that dust and the like from bearings of the spinning machine may adhere to the substrate. These are factors which can cause defects in patterns formed on the substrate.

For other methods to solve these problems, there are drying by blowing hot air; utilizing vapor of an organic solvent; utilizing surface tension of a liquid, and so on, but there remains problems shown below.

(1) After drying by blowing hot air, evaporation marks of the water drops may remain.

(2) Because the method of removing water by exposure to the vapor of an organic solvent requires a large quantity of the organic solvent, and in addition solvent is heated to evaporate, there is constant danger of catching fire and explosion.

(3) In one method, water is removed from a surface utilizing the surface tension of the water as the substrate is slowly lifted from it. In this method, D. I. water which is supplied to a tank and which conducts the cleaning overflows from the tank. However, as a result of the inventors examination, the following problems may arise in this method.

With particular reference now to FIG. 14, a sectional view showing the state wherein the substrate 3 contained in the cassette 1 is being immersed into D. I. water 30 of a tank 9 according to above describe method (3), the D. I. water 30 is supplied from the lower part of tank 9 to conduct cleaning, overflowing from top edges of side walls 10 of the tank 9. If the water 30 is not allowed to overflow uniformly from the top of the all side walls 10, problems may arise. Thus, the edge of the side walls 10 must be precisely horizontal in order to make the water 30 overflow uniformly. It is very difficult to make the tank 9 with such precision. Supplying a large amount of the water would solve the problem, but this raises the cleaning cost. When the substrate 3 is immersed into and lifted from the water 30, dust, for example, created by the vertical lift mechanism (not shown) which moves a cassette conveying arm 38 holding, originally adhered to the cassette and the substrate themselves, or existing in the water, might float to the surface of the water 30. At this time, if the overflow of the D. I. water 30 from the tank 9 is not uniform from the top of the four side walls 10, the flow of the water 30 becomes inactive and stagnant in some part of the tank 9.

FIGS. 15 and 16, enlarged sectional views of the apparatus of FIG. 14, show movement of the dust to a place where the flow of the D. I. water becomes inactive and stagnate. In these Figures, only a piece of one substrate 3 is shown, although there may actually be contained, for example, a large number of substrates cassette.

FIG. 15 particularly shows the state of the substrate 3 as it is being lowered to be immersed into the water 30. As previously described, if, for example, dust caused by the vertical lift mechanism falls onto the water 30, this dust 8A, shown floating on liquid surface **30*a*, is not flowed out of the tank in the place where the water is stagnant, but enters the water 30 and may adhere to the substrate 3. Dust 8B adhering to the substrate 3 might not be removed even by the upward flow of the water, because the flow of the water is inactive in an area of a minute width adjacent to the substrate 3**.

As shown in FIG. 16, as the substrate 3 is lifted from the water, after the substrate 3 has been cleaned for a predetermined time, the dust 8A previously described floating on the surface **30*a* of the water 30 and which is not flowed out of the tank, may adhere to the substrate 3 when it is lifted, led by the water which makes the substrate 3 wet. Therefore, in addition to above described dust 8B, the substrate 3 is further contaminated by dust 8C** which adheres thereto when it is lifted.

Dust particles 8B and 8C remain adhered to the substrate 3 even after it is dried, which could lead to substrate contamination or defects in patterns formed later on the substrate.

These problems arise also in chemical treatment of substrates or other objects, besides in water cleaning treatment.

SUMMARY OF THE INVENTION

A purpose of the invention is to provide an apparatus for treating substrates or wafers with a liquid wherein the overflow of the liquid is made uniform and is made not to stagnate so that foreign substances, such as dust, do not adhere to the substrates or wafers.

In accordance with a broad aspect of this invention, an apparatus for treating a substrate with a liquid is provided in which the substrate is immersed into the liquid in a tank with said liquid overflowing from the tank. Overflow control members are provided for faces of said tank with a predetermined space in an overflow area of said liquid, wherein said space is structured to lead the overflow of said liquid by capillary action.

BRIEF DESCRIPTION OF THE DRAWINGS

FIG. 1 is a sectional view showing a cleaning process of a semiconductor wafer and an apparatus for performing the same, in accordance with the invention;

FIG. 2 is an enlarged front sectional view of a portion of FIG. 1;

FIG. 3 is an enlarged front sectional view of a portion of FIG. 1 in bubbling;

FIG. 4 is an enlarged front sectional view of a portion of a tank (cleaning tank);

FIG. 5 is a sectional view of a bubble generator used in the apparatus of FIG. 1;

FIG. 6 is a perspective view of the bubble generator of FIG. 5;

FIG. 7 is a diagram showing an entire cleaning apparatus in accordance with the invention;

FIG. 8 is a sectional view of a main part of a semiconductor wafer cassette;

FIG. 9 is a sectional view taken along the line IX–IX of FIG. 8;

FIG. 10 is an enlarged view of a portion of FIG. 8; and

FIG. 11 is an enlarged sectional view of a portion of an apparatus according to another embodiment.

FIG. 12 is a perspective view of a cassette;

FIG. 13 is a sectional view of the state of a semiconductor wafer when contained in the cassette of FIG. 12;

FIG. 14 is a sectional view of an apparatus when the semiconductor wafer is being cleaned;

FIG. 15 is a schematic view illustrating the movement of dust when the semiconductor wafer is being immersed into the water; and FIG. 16 is a schematic view illustrating the movement of dust when the semiconductor wafer is being lifted from the water.

DESCRIPTION OF THE PREFERRED EMBODIMENTS

Hereinafter, the embodiments of the invention will be described.

Figure 1:
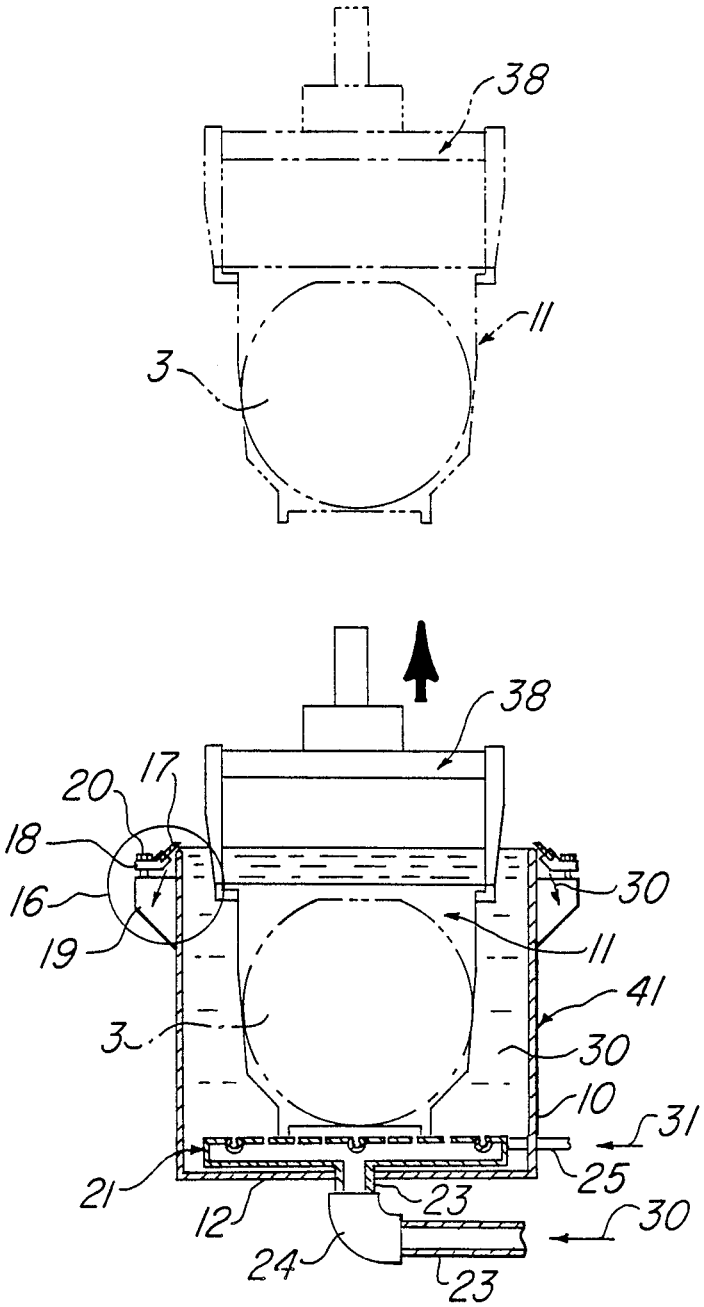
FIGS. 1–11 shows embodiments of the invention.

FIG. 1 shows a method of cleaning semiconductor wafers according to an embodiment of this invention.

According to this embodiment, a semiconductor wafer 3 is set in a cassette (carrier) 11 which will be described later. The cassette is placed in a tank 41, the hot D. I. water 30 is supplied to this tank 41, keeping its surface always clean by uniformly overflowing from the periphery of the tank 41. After a period of time, the cleaned substrate 3 and cassette 11 are lifted by a cassette conveying arm 38 provided over the tank 41 to a position shown in dashed lines to complete cleaning.

The D. I. water 30 is supplied through a pipe 23 which penetrates the bottom of the tank 41 to a bubble generator 21 (which will be described in detail later in conjunction with FIGS. 5 and 6) to enter the tank 41.

An important aspect of the above is that a knife edge like plate 17 with a sharpened tip (hereinafter referred as a knife edge) is provided with a small slit over the side walls 10 of the tank 41.

Figure 2:
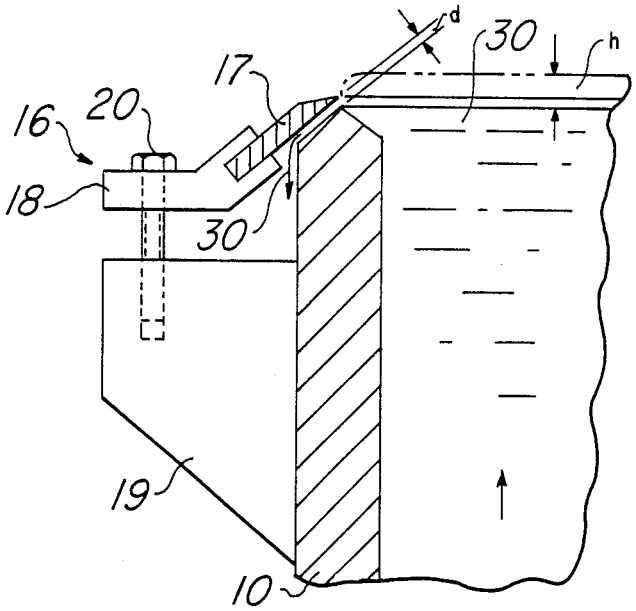
Figure 4:
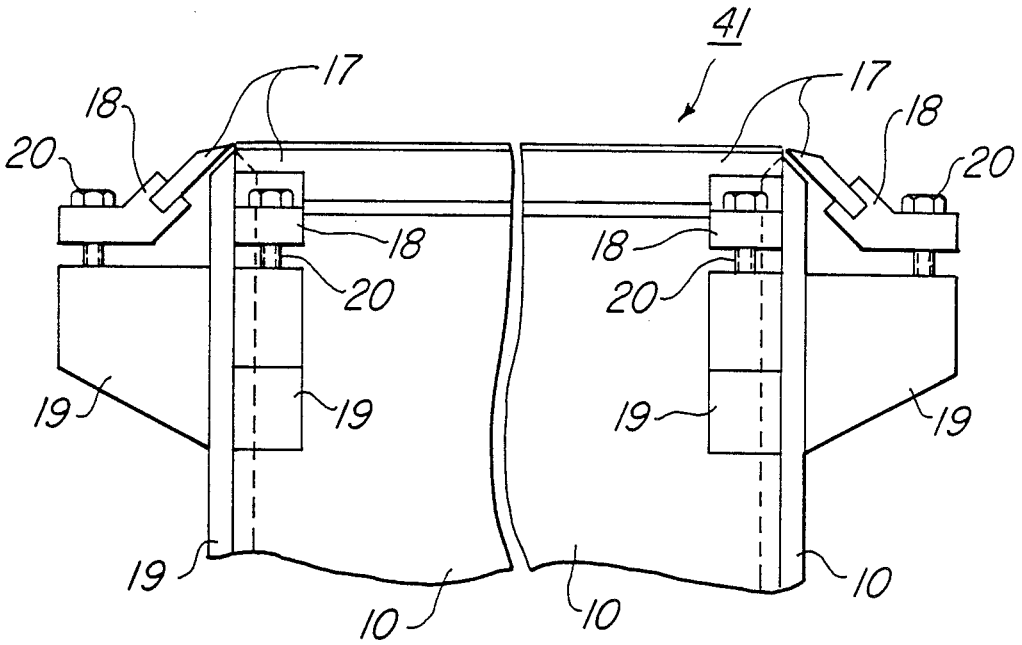
Figure 15:
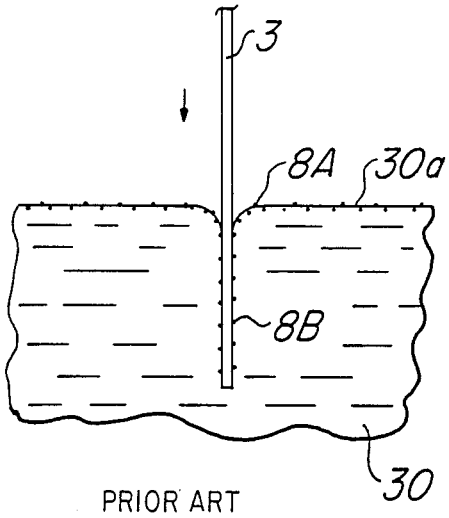
PRIOR ART Fig. 15
Figure 16:
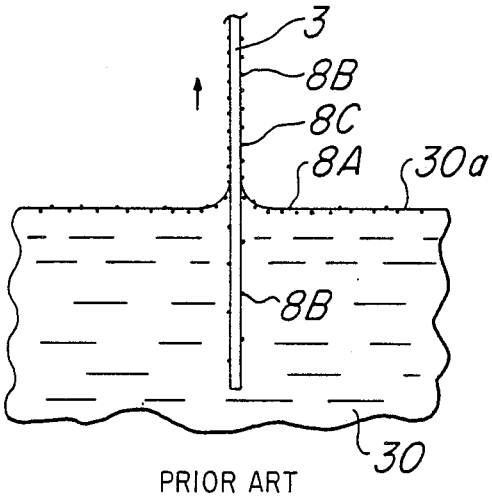
PRIOR ART Fig. 16

An enlarged area 16 including the knife edge 17 is shown in FIG. 2. The top end of the side wall 10 has a mountain like shape, and the knife edge 17 is positioned with an outer sloping face above a silt d. The knife edge 17 is held by a knife edge holder 18, which is fixed to a bracket 19 mounted on an outer face of the side wall 10 by a bolt 20. The slit d is made to be adjustable by the adjusting bolt 20. As shown in FIG. 4, the knife edges 17 are provided across the width of the side walls 10, and the D. I. water of the tank is forced to overflow by capillary action (suction action under atmospheric pressure) of the slit between the side wall 10 and the knife edge 17. Hence, even if the top ends of the side walls 10 are not completely vertical, the D. I. water 30 overflows as shown by an arrow 30 in FIG. 2 uniformly from the top periphery of the side walls 10, reducing any problem from stagnation of the water, as above described in conjuction with FIGS. 15 and 16. That is, the knife edges 17 function to control the overflow. Thus, dust (8A in FIGS. 15 and 16) is overflowed on a uniform flow of the D. I. water 30 out of the tank. If there were no knife edges 17 (for example, as in the state shown in FIG. 15), the liquid face of the D. I. water 30 is raised by surface tension to momentarily stop the overflow as shown by the dashed line in FIG. 2, before a steady state is begun. However, with the knife edges 17 provided, their sharp edges prevent the D. I. water from raising by breaking the surface tension, so that the overflow does not stop momentarily. In order that the knife edges break the surface tension of the water, the tip of the knife edge may be placed slightly inward of the top end of the side wall 10. A distance h between the top end of the side wall 10 and the liquid face, shown in phantom in FIG. 2, representing the raise of the D. I. water, is normally around 3 mm. The distance d between the top end of the side wall 10 and the knife edge 17 may be around 1 mm. Using these dimensions, the overflow of the D. I. water is made uniform by the function of capillary action. A desirable result is achieved especially by knife edges made of quartz in that the D. I. water can be made to overflow from the periphery of the side walls even with a small supply of the D. I. water.

Figure 5:
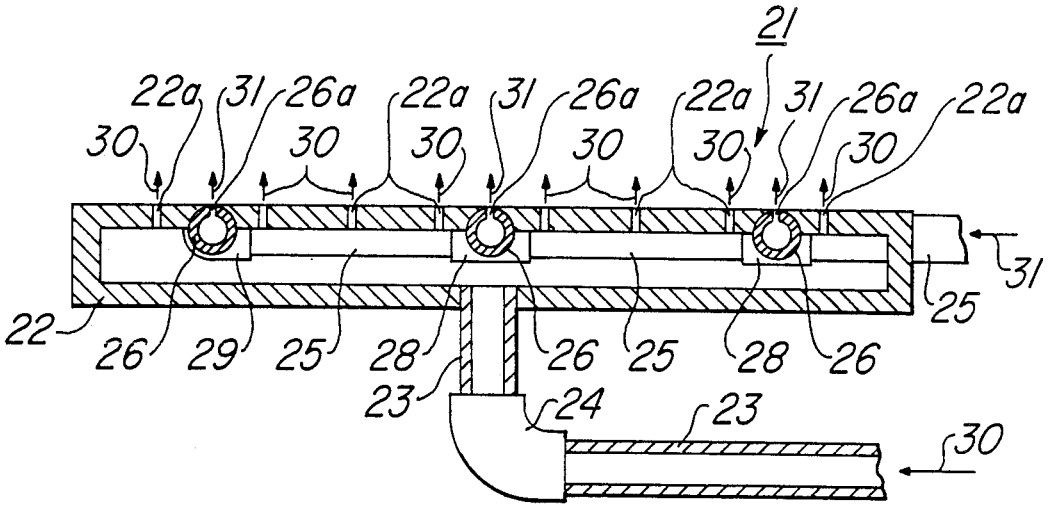
Figure 6:
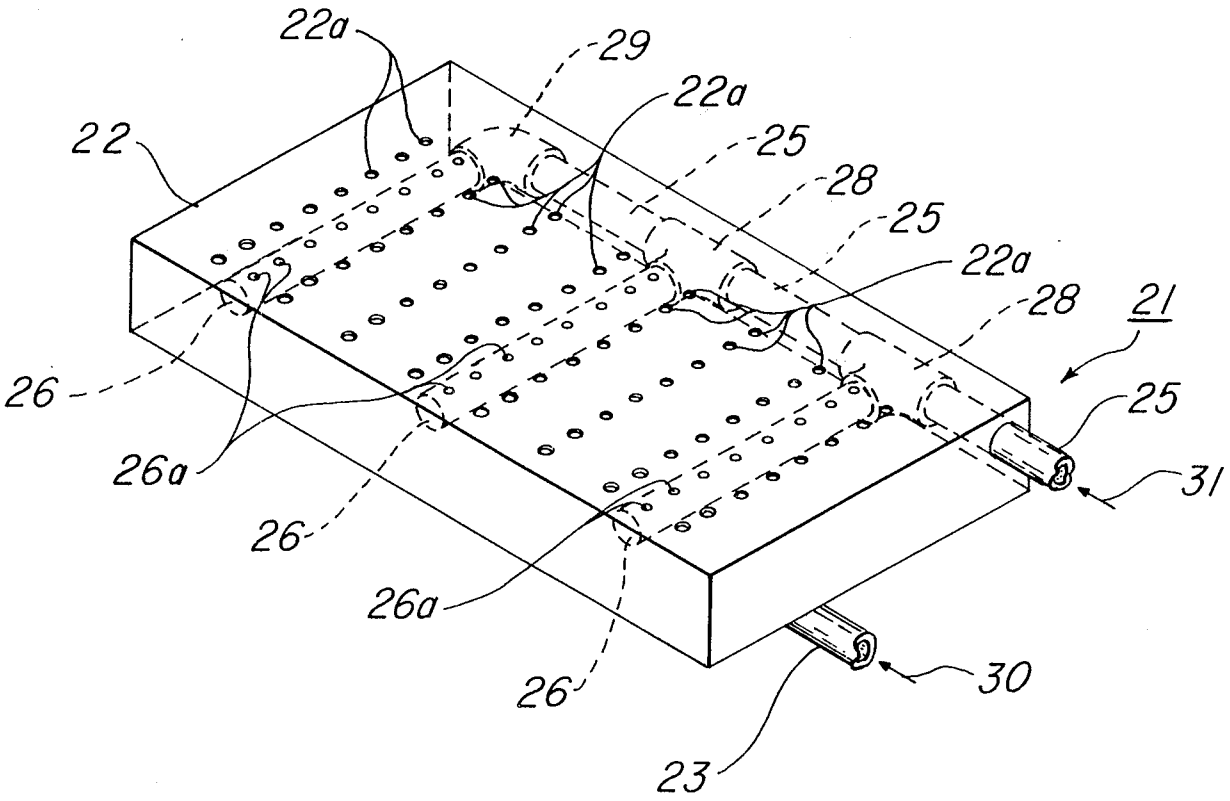

FIG. 5 is an enlarged sectional view of the bubble generator 21 of FIG. 1, and FIG. 6 is an enlarged perspective view thereof.

The pipe 23 conducts the D. I. water 30 to the middle of the bottom of a flat box 22 having a plurality of holes 22*a* penetrating its top. Also a plurality of (three in this case) smaller pipes 26 which supply gas (nitrogen gas in this embodiment) are fixed to the top, parallel to one another, their top faces being positioned at the same height as the surface of the top and having a plurality of upwardly facing holes 26*a*. The smaller pipes 26 are connected by T shaped connectors (Tees) 28 and an elbow 29 to a gas supply pipe 25 entering from outside of box 22. Therefore, when the D. I. water 30 is supplied from the pipe 23 and the nitrogen gas 31 is supplied from the pipe 25, the D. I. water 30 is supplied to the tank 41 via the holes 22*a*, and the nitrogen gas 31 is supplied to the tank via the holes 26*a* of the smaller pipes 26 to rise through the tank as bubbles in the D. I. water.

Figure 3:
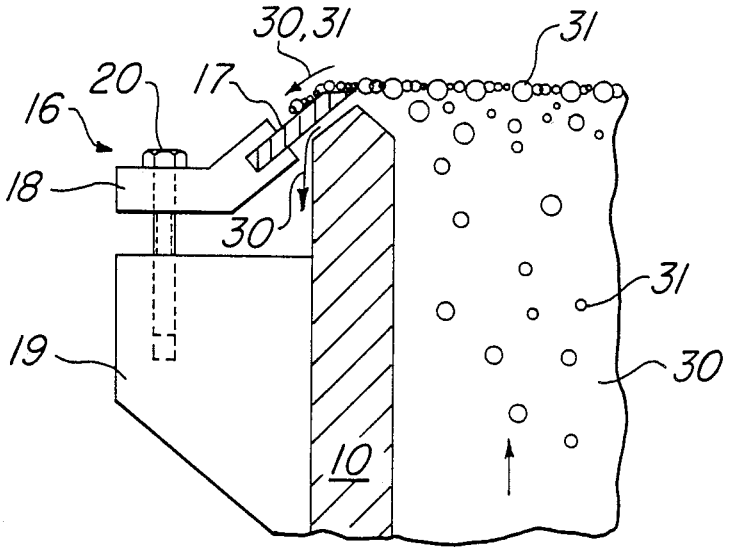

FIG. 3 is the same enlarged partially sectional view of FIG. 2 when the nitrogen gas is supplied.

The D. I. water 30 rises inside the tank and overflows from the slit between the outer sloping face of the side wall 10 and the knife edge 17 as shown in FIG. 2. At the same time, the bubbles of the nitrogen gas 31 rise through the D. I. water 30 to intensely stir the D. I. water 30 (bubbling). The D. I. water 30 also rises in narrow areas (not shown) adjacent to the substrate almost as simultaneously as in the other areas, and foreign substances such as dust on the substrate are removed, resulting in prominent cleaning effect. A highly viscid liquid such as sulfuric acid in previous process can also be used in the cleaning apparatus of the invention. The bubbles of the nitrogen gas 31 are overflowed to the outside of the side wall 10 over the knife edge 17 with some D. I. water 30.

The above bubbling occurs in the process of lowering the substrate into the D. I. water, and it bubbles periodically while the substrate is being immersed. The bubbling stops when the substrate is being lifted from the D. I. water to make the D. I. water 30 overflow calmly, preventing the foreign substances such as dust from adhering to the substrate.

Figure 7:
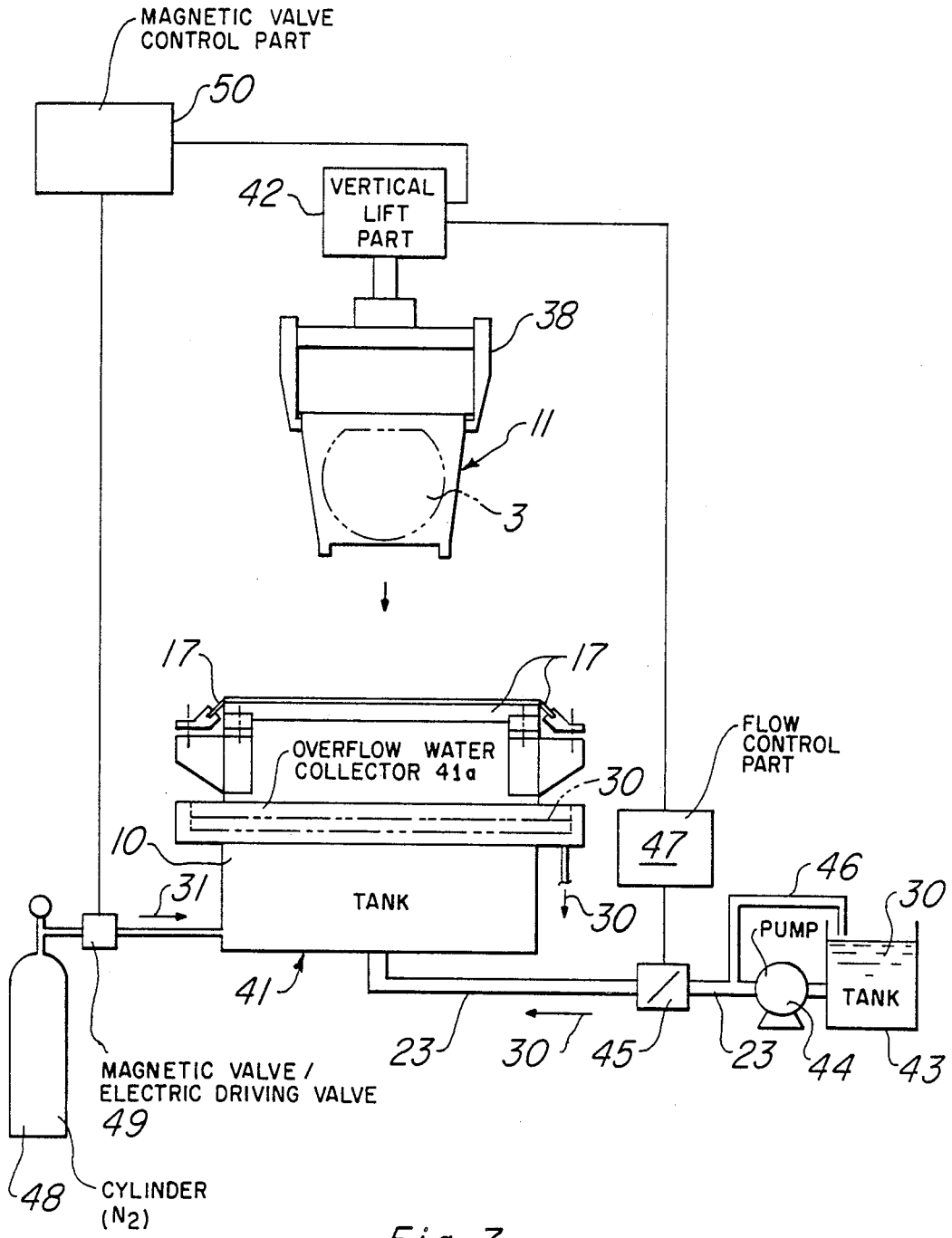

FIG. 7 is a diagram showing the relation of each part constituting the water cleaning.

The D. I. water 30 overflowed from the tank 41 is once stored in an overflow water collector 41*a* provided around the outside of the tank side walls and is drained out of the equipment.

The D. I. water 30 in the tank 43 is supplied through the pipe 23, a pump 44, and a flow control valve 45 to the inside of the tank 41. A branch pipe 46 is provided between the tank 43 and the pipe 23 which is between the pump 44 and the flow control valve 45, in order to return excess D. I. water into the tank 43. Also the nitrogen gas 31 in a cylinder 48 is supplied through a magnetic valve/electric driving valve (referred as "magnetic valve" hereinafter) 49 and the gas supply pipe 25 to the inside of the tank 41.

When the vertical lift part 42, which moves the cassette conveying arm 38 vertically, operates to make the cassette conveying arm 38 begin to descend, a magnetic valve control part 50 receiving a signal from the vertical lift part 42, opens the magnetic valve 49 and the gas 31 in the cylinder 48 is supplied to the tank 41 to start bubbling. When the substrate 3 is immersed into the D. I. water 30, the magnetic valve control part 50 opens and closes the magnetic valve 49 according to a predetermined program, making the bubbling periodical. The reason to make the bubbling periodical is to float foreign substances, such as dust removed from the substrate, onto the liquid face, not allowing them to adhere to the substrate again.

When the water cleaning of the substrate is finished and the vertical lift part 42 operates to make the cassette conveying arm 38 begin to ascend, the magnetic control part 50 receiving a signal from the vertical lift part 42 closes the magnetic valve 49 and the bubbling stops; at the same time the flow control part 47 opens the flow control valve 45, also receiving the above signal, to increase the supply of the D. I. water 30 to the tank. This is to prevent decreasing or stopping of the D. I. water overflow with the liquid face thereof lowered, as the substrate 3 and the cassette 11 are lifted from the D. I. water.

Upon completion of the above water cleaning, the cassette conveying arm 38 is moved horizontally by the driving mechanism (not shown) to change the cassette 11 containing the cleaned substrate with another cassette containing an uncleaned substrate, returning to the upper region of the tank 41 to continuously perform next cleaning.

Although the above embodiment has been described with regard to the water cleaning of substrates, the above described bubbling is not always necessary in chemical treatment of objects. Also, in the narrow areas of the fluid which is in contact with the wafer or object, chemical solution is less capable of treating these areas. Thus, the bubbling may be performed either periodically or continuously, as appropriate, as the subject of treatment is immersed into the solution.

Next, the structure of the cassette 11 used in this invention will be described in conjunction with FIGS. 8–11.

Figure 8:
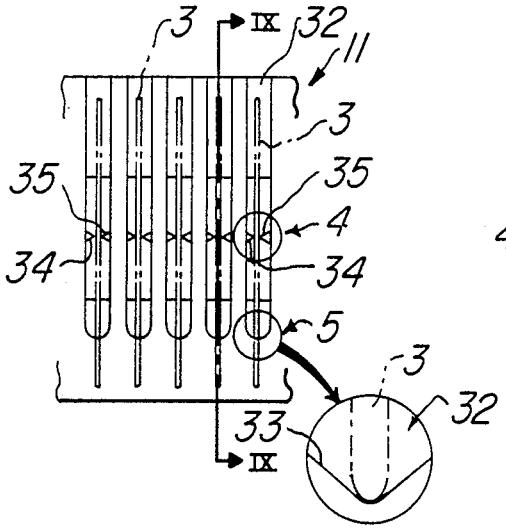
Figure 9:
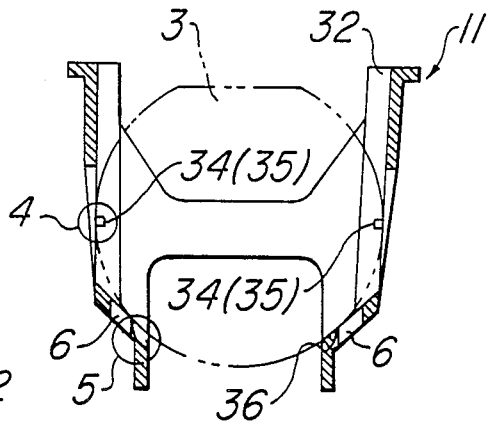
Figure 10:
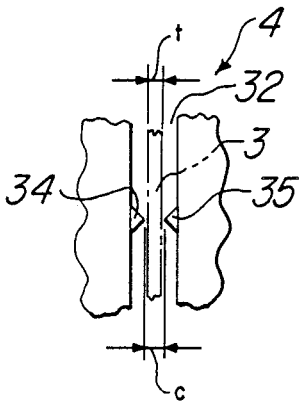

A substrate support part 5 at the bottom of a U shaped groove 32 of the cassette 11 has a pair of inversely sloping tapers forming its bottom wall 33, as shown in the enlarged view of FIG. 8. An inwardly deepened slope 36 toward the cassette is provided as shown in a sectional view of FIG. 9 taken along a line IX—IX of FIG. 8. In addition, as shown in FIG. 10, there is a pair of projections 34 and 35 provided symmetrically on the both sides of the groove 32 toward the substrate 3. In this area 4, a space C between projections the 34 and 35 is slightly wider than a thickness t of the substrate 3, and the projections 35 hold the substrate vertically making point-contact lightly with its tips. Also, the lower edge of the substrate 3 makes point-contact with the center of the bottom wall 33.

Therefore, the substrate is always in a neutral state and stable in the center of the groove such that the space of the groove side wall is kept constant and wide, which results, with the point support at the bottom, in improved replacement efficiency of fluid (liquid and gas). That is, by making the support part (bottom part) of the cassette 11 U shaped, the substrate 3 whose lower edge contacts there is kept in the center of the groove as well as supported by the point-contact. Furthermore, in order to prevent the upper part of the substrate from sloping, the substrate can be held stably in the center of the groove, by the projections 34 and 35 on the sides of the groove. Thus, the stagnation of liquid can be prevented, and cleaning can be performed effectively with the substrate kept still, which contribute to high quality of semiconductor. The above support part may be a V shaped groove.

The cassette 11 can be made with a material such as Teflon.

The above equipment can be applied to chemical treatment of substrates with chemical solutions (e.g., etching) and to drying after cleaning, besides the above cleaning. That is, an etching process for patterning by a photoetching method, a water cleaning process after the etching, and a drying process after the cleaning can be performed continuously with 3 sets of equipment placed in series. In the etching process, etch resistant material is used for parts which make contact with chemical solutions. In this process, the chemical solutions do not stagnate and are supplied equally to each substrate, and the treatment can be performed uniformly.

The drying process uses the hot D. I. water from which the substrate is slowly lifted. The water on the substrate 3 and the cassette 11 are removed utilizing the surface tension of the water, which causes no liquid stagnation. Small amount of water left will be evaporated and dried shortly by the remaining heat of the substrate 3 and the cassette 11.

The conditions for the above treatment are as follows:

Temperature of hot D. I. water: 45–65 degrees C.

Lifting speed of substrates: 2 cm/min.

Time required for complete drying after finishing lifting substrates: a few seconds.

As can be seen in the above, by the method of the invention, substrates are effectively dried just by being lifted from the hot D. I. water. When the substrates are lifted, because of the above described knife edges, replacement efficiency of the water face is heightened, cleanliness of the water surface can be maintained, and the substrate can be dried with little dust thereon.

On the substrates which have finished etching, water cleaning, and drying processes, as above, the number of the foreign substances such as dust is decreased to 1/40–1/50, compared to that of a case in which an equipment without the knife edge is used.

Figure 11:
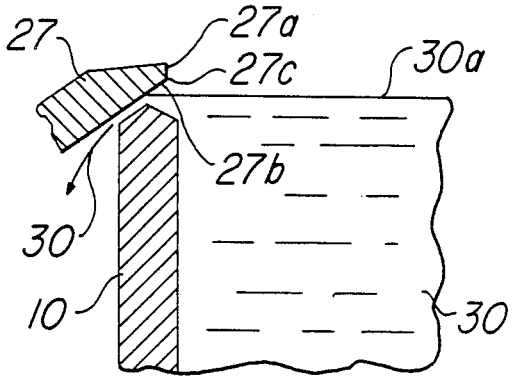
Figure 12:
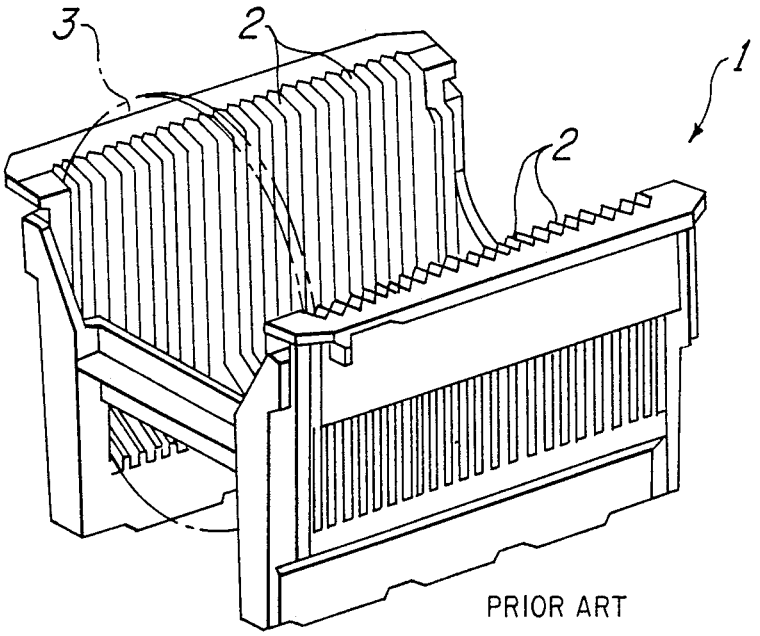
FIG. 12–16 show prior art.
Figure 13:
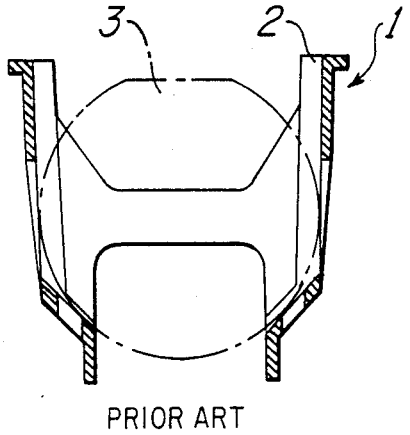
Figure 14:
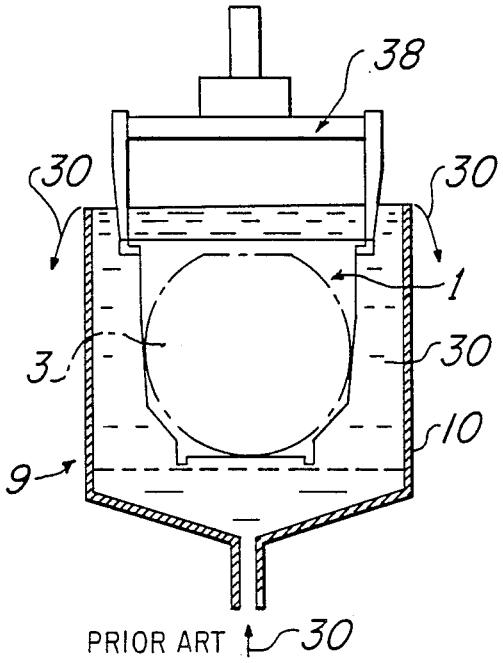

The knife edges 17 in FIGS. 2 and 3 may be alternatively shaped like a knife edge 27 in FIG. 11. Although a knife edge holder, a bracket, and a bolt (18, 19, and 20 in FIGS. 2 and 3) are omitted in FIG. 11, it does not differ from the embodiment shown in FIG. 2 and 3 besides the shape of the knife edge 27.

The end of the knife edge 27 has a vertical face 27*a*, which is disposed inside of the top end of the side wall 10. By making the knife edge 27 in this manner, a lower sloping face 27*b* (which is wider than that of FIGS. 2 and 3) of the knife edge 27 makes contact with a liquid face 30*a* of the D. I. water 30, allowing the horizontal positioning of the knife edge 27 to be less strict. Thus, the tank can be structured easily. The above described breaking of the surface tension of the D. I. water (the dashed line of FIG. 2) can be achieved by a corner 27*c* formed by the end face 27*a* and the lower sloping face 27*b*.

Although the invention has been illustrated hereinabove, the above embodiment may be further modified based on the technical idea of the invention.

For example, the material, shapes, and way of furnishing of the knife edges 17 and 27 may be of other appropriate materials, shapes, and ways of furnishing. The top end of the side wall 10 may be appropriately shaped depending on the shape of the knife edge. In the above embodiment, the cassette was made of Teflon, but the same result can be achieved with ones of the other materials. Also in the above embodiment, it is possible to complete the drying only by a cleaning tank without introducing a separate dryer, by supplying the hot D. I. water in the final D. I. water tank inside the automatic cleaning equipment and utilizing an exclusive cassette and a cassette conveying robot for lifting. Furthermore, the present invention may be applied to treatments besides etching, cleaning and drying, and objects may be various besides the semiconductor wafers.

EFFECTS OF THE INVENTION

In this invention, overflow control members are provided for faces of a tank with a predetermined space at overflow areas of a liquid, and said space is made to lead the overflow of the liquid by capillary action so that the overflow occurs forcedly by suction action of capillarity under atmospheric pressure. Therefore, the liquid overflows uniformly at the entire periphery of the tank, without any place at which the liquid stagnates. As a result, undesirable foreign substances such as dust do not adhere to an object of the treatment, discharged effectively out of the tank, and the liquid is supplied uniformly to the surface of the object of the treatment, and the quality of the object of the treatment is not affected to deteriorate after the treatment.

What is claimed is:

1. Apparatus for subjecting an object to a liquid treatment while reducing potential contamination of the object when the liquid treatment is completed, said apparatus comprising:

a vertically upstanding container having an open top bounded by container wall means and adapted to receive treatment liquid therein into which the object to be subjected to the liquid treatment is to be immersed, said container wall means having a peripheral brim surrounding the open top of the container and over which liquid is to be overflowed;

means for introducing liquid into the container in a fill procedure continuing after the container has been completely filled to promote overflow of liquid in a continuing manner with respect to the peripheral brim of the container wall means;

overflow control means including at least one overflow control element mounted at the exterior of said container wall means and located at and extending along the entire extent of the peripheral brim thereof; and said overflow control means cooperating with the peripheral brim of said container wall means to define a peripheral capillary gap therebetween which slopes downwardly from an inner end of higher elevation to an outer end of lower elevation;

whereby continuing overflow of liquid is maintained along the entire extent of the peripheral brim of said container wall means through the peripheral capillary gap by virtue of capillary action to promote uniform liquid overflow with respect to the peripheral brim of said container wall means while the object subjected to the liquid treatment is being removed from the liquid in the container, thereby reducing the incidence of contamination of the object by foreign particles tending to float on the surface of the liquid in the container.

2. Apparatus as set forth in claim 1, wherein said at least one overflow element disposed in downwardly sloping relationship with respect to the peripheral brim of said container wall means and is provided with an inwardly tapering inner end portion defining a knife edge at the inner end thereof corresponding to the inner end of the peripheral capillary gap.

3. Apparatus as set forth in claim 2, wherein said knife edge of said at least one overflow control element is disposed inwardly with respect to said peripheral brim of said container wall means for overcoming the effect of surface tension on the liquid within the container, thereby avoiding a momentary cessation in the liquid overflow of the peripheral brim of said container wall means.

4. Apparatus as set forth in claim 3, wherein said at least one overflow control element and said container wall means are respectively provided with substantially parallel opposing cooperating surfaces in defining the peripheral capillary gap between said overflow control means and the peripheral brim of said container wall means.

5. Apparatus as set forth in claim 1, wherein the top portion of said container wall means is provided with oppositely sloping intersecting surfaces defining an apex as the peripheral brim of said container wall means.

6. Apparatus as set forth in claim 1, further including means for introducing an inert gas into the interior of said container, whereby inert gas bubbles are adapted to be provided in the body of the liquid within said container for rising to the top surface of the liquid to agitate the liquid within said container during one phase of the liquid treatment procedure conducted on the object.

7. Apparatus as set forth in claim 1, wherein said overflow control means further includes means affixed to the exterior of said container wall means in proximate relation to the peripheral brim thereof and attached to said at least one overflow control element for mounting said at least one overflow control element at the exterior of said container wall means and located at and extending along the entire extent of the peripheral brim thereof.

8. Apparatus as set forth in claim 7, further including an overflow liquid collector receptacle surrounding said container wall means and located beneath said mounting means and said at least one overflow control element, said liquid collector receptacle providing an upwardly open trough for collecting overflow liquid.

* * * * *